US012196506B2

(12) United States Patent
Nothdurft et al.

(10) Patent No.: US 12,196,506 B2
(45) Date of Patent: Jan. 14, 2025

(54) HEAT EXCHANGER

(71) Applicant: MAHLE International GmbH, Stuttgart (DE)

(72) Inventors: Benjamin Nothdurft, Vaihingen/Enz (DE); Uwe Foerster, Erdmannhausen (DE); Martin Sievers, Kernen im Remstal (DE); Gottfried Duerr, Ludwigsburg (DE); Patrick Walz, Engelsbrand (DE); Nikolaj Bittner, Esslingen am Neckar (DE)

(73) Assignee: Mahle International GmbH, Stuttgart (DE)

( * ) Notice: Subject to any disclaimer, the term of this patent is extended or adjusted under 35 U.S.C. 154(b) by 0 days.

(21) Appl. No.: 17/884,333

(22) Filed: Aug. 9, 2022

(65) Prior Publication Data

US 2023/0052183 A1 Feb. 16, 2023

(30) Foreign Application Priority Data

Aug. 10, 2021 (DE) ..... 10 2021 208 717.5

(51) Int. Cl.
*F28F 9/02* (2006.01)
*F28D 1/053* (2006.01)
*F28F 9/16* (2006.01)

(52) U.S. Cl.
CPC ..... *F28F 9/0278* (2013.01); *F28D 1/05316* (2013.01); *F28F 9/0221* (2013.01); *F28F 9/16* (2013.01); *F28F 2240/00* (2013.01)

(58) Field of Classification Search
CPC ..... F28D 1/05316; F28D 1/05391; F28F 9/0221; F28F 9/0278; F28F 9/16;
(Continued)

(56) References Cited

U.S. PATENT DOCUMENTS 7,571,761 B2 8/2009 Katoh et al.
2003/0188857 A1* 10/2003 Kawakubo ..... F28F 9/0243 165/174

(Continued)

FOREIGN PATENT DOCUMENTS

DE 9111412 U1 10/1991
DE 102005029171 A1 2/2006

(Continued)

*Primary Examiner* — Eric S Ruppert
*Assistant Examiner* — Hans R Weiland
(74) *Attorney, Agent, or Firm* — Muncy, Geissler, Olds & Lowe, P.C.

(57) ABSTRACT

A heat exchanger including a tube/rib block made up of tubes and ribs, the tubes forming fluid channels for conducting a first fluid, in particular a refrigerant, and the ribs arranged between the tubes forming a second fluid channel for conducting a second fluid, such as, in particular, air, which flows around the tubes, a collector being arranged at at least one end of the tube/rib block, which communicates with the fluid channels of the tubes, the at least one collector being provided with a plate-type design and including at least one base plate and a cover plate, which are stacked and soldered in a sealed manner, a spacer for spacing the base plate at a distance from the cover plate and for distributing the first fluid in the collector being provided.

18 Claims, 5 Drawing Sheets

(58) Field of Classification Search
CPC ..... F28F 9/18; F28F 17/005; F28F 2240/00; F28F 2225/08
See application file for complete search history.

(56) References Cited

U.S. PATENT DOCUMENTS

2005/0235691 A1* 10/2005 Katoh ..... F28D 1/05391 62/515
2005/0284621 A1* 12/2005 Katoh ..... F28F 9/0221 165/174
2006/0162917 A1* 7/2006 Park ..... F28F 9/0221 62/509
2007/0175620 A1 8/2007 Watanabe et al.
2007/0209386 A1* 9/2007 Higashiyama ..... F28D 1/05391 62/515
2008/0314076 A1* 12/2008 Ichiyanagi ..... F25B 9/008 165/173
2010/0186934 A1* 7/2010 Bellenfant ..... F28D 1/0408 165/174
2014/0174703 A1* 6/2014 Yoshioka ..... F28F 9/0243 165/173
2014/0318749 A1* 10/2014 Katoh ..... B60H 1/00328 165/151
2015/0241131 A1* 8/2015 Katoh ..... F28D 1/05366 165/140

FOREIGN PATENT DOCUMENTS

EP 1780490 A1 5/2007
FR 3025304 A1 3/2016
JP 2007170715 A * 7/2007
WO WO2006129598 A1 12/2006

* cited by examiner

HEAT EXCHANGER

This nonprovisional application claims priority under 35 U.S.C. § 119(a) to German Patent Application No. 10 2021 208 717.5, which was filed in Germany on Aug. 10, 2021, and which is herein incorporated by reference.

BACKGROUND OF THE INVENTION

Field of the Invention

The present invention relates to a heat exchanger, in particular for a refrigerant circuit of a motor vehicle.

Background Information of the Invention

In motor vehicles, many different kinds of heat exchangers for the refrigerant circuit of a motor vehicle are known, for example, as evaporator or chillers for cooling air for the vehicle interior of the motor vehicle, or for cooling a fluid, for example, for cooling other assemblies, for example a battery arrangement.

The requirements of the vehicle manufacturers for a low weight, reduced installation space requirements and an improved efficiency of the heat exchanger are increasing steadily, because steadily increasing requirements of the vehicle customers and the lawmakers for the efficiency of the motor vehicles also result in corresponding requirements for the components of the motor vehicles.

This applies, in particular, to heat exchangers for the refrigerant R1234yf and to an even greater degree to heat exchangers for the refrigerant R744, also known as $CO_2$, since these heat exchangers must withstand much higher pressures, which generally imposes stricter requirements on the wall thickness of the components of the heat exchanger and on its design.

For evaporators as heat exchangers for R744 as the refrigerant, designs are known, for example through EP 1 780 490 B1, FR 3 025 304 A1 and DE 10 2005 029 171 A1 (which corresponds to US2005/0284621), in which the collector of the heat exchanger is provided with a plate-type design. A base plate, at least one intermediate plate and a cover plate are provided, which are stacked on top of each other and are soldered to each other.

The base plate is designed in such a way that it has openings for the introduction and for the sealing connection of tube ends of the tubes of the tube/rib block. The cover plate is typically designed to be flat or to have at least one concavity for the purpose of designing the collector to be upwardly closed, the at least one possible concavity being used to guide the flow of the refrigerant within the collector. The intermediate plate also has openings to conduct the refrigerant flowing in from the tubes, or for conducting the refrigerant flowing toward the tube ends, possible connecting channels between the openings in the intermediate plate being used to distribute the refrigerant. The openings in the intermediate plant are to be designed to be larger than the openings in the base plate, so that solder from the intermediate space between the intermediate plate and the base plate does not enter the tube openings of the tube ends of the tubes and block the cross-section of the tube openings. Correspondingly, the particular opening in the intermediately plate may be larger all around with respect to the openings in the base plate.

The intermediate plate has a peripheral web between the openings and the side edge of the intermediate plate on the longitudinal side thereof, which typically has the width of the wall thickness of the intermediate plate, i.e., the thickness of the intermediate plate. This peripheral web typically shares responsibility for the fact that the collector has a projection with respect to the tube/rib block in the air flow direction, which helps determine the structural depth of the heat exchanger in the air flow direction. The structural depth of the heat exchanger is typically the depth of the tube/rib block in the air flow direction plus twice the projection, i.e., the projection on the air inflow side and the projection on the air outflow side. The width of the peripheral web of the intermediate place thus at least indirectly determines the structural depth of the heat exchanger.

SUMMARY OF THE INVENTION

It is therefore an object of the present invention to provide a heat exchanger, which is improved over the prior art and has a low weight, reduced installation space requirements and an improved efficiency.

An exemplary embodiment of the invention relates to a heat exchanger including a tube/rib block made up of tubes and ribs, the tubes forming fluid channels for conducting a first fluid, in particular a refrigerant, and the ribs arranged between the tubes forming a second fluid channel for conducting a second fluid, such as, in particular, air, which flows around the tubes, a collector being arranged at at least one end of the tube/rib block, which communicates with the fluid channels of the tubes, the at least one collector having a plate-type design and including at least one base plate and a cover plate, which are stacked and soldered in a sealed manner, a spacer for spacing the base plate at a distance from the cover plate and for distributing the first fluid in the collector being also provided, the base plate having first openings for the receipt and sealed fastening of tube ends of the tubes of the tube/rib block, the first openings in the base plate being surrounded by an edge of the base plate, the spacer having second openings, the first openings being in alignment with the second openings, the second openings being designed to be larger with respect to the first openings and to be laterally open. This achieves, on the one hand, that no solder runs into the tube ends of the tubs of the tube/rib block and blocks the tube ends during the soldering of the heat exchanger and, on the other hand, it is achieved that the projection of the collector relative to the tube/rib block may be kept narrow, so that the installation space required by the heat exchanger may be reduced.

It is also particularly advantageous if the spacer is designed as an intermediate plate, which is arranged between the base plate and the cover plate. By arranging an intermediate plate having the laterally open second openings, the intermediate plate may be kept narrow, because the lateral side web is omitted, which would laterally close the second openings.

It is also advantageous if the spacer is designed as an intermediate element or as intermediate elements, which is or are integrated into the base plate and/or into the cover plate. Parts of the base plate and/or the cover plate may thus act as spacers, which position the base plate and the cover plate a distance apart for the purpose of improving throughlow, a penetration of solder into the tube ends further being prevented.

It may also be advantageous if a distribution plate is arranged, which has channel openings extending in the longitudinal direction of the collector. Together with the base plate, the intermediate plate and the cover plate, a four-plate arrangement may be achieved thereby. The distribution plate may be arranged between the intermediate plate and the cover plate or between the intermediate plate and the base plate, while the intermediate plate is arranged between the base plate and the distribution plate or between the distribution plate and the cover plate. In a three-plate arrangement, the intermediate plate is arranged between the base plate and the cover plate, or the distribution plate is arranged between the base plate and the cover plate.

An exemplary embodiment of the invention also relates to a heat exchanger including a tube/rib block made up of tubes and ribs, the tubes forming fluid channels for conducting a first fluid, in particular a refrigerant, and the ribs arranged between the tubes forming a second fluid channel for conducting a second fluid, such as, in particular, air, which flows around the tubes, a collector being arranged at at least one end of the tube/rib block, which communicates with the fluid channels of the tubes, the at least one collector having a plate-type design and including at least one base plate and a cover plate, which are stacked and soldered in a sealed manner, a spacer for spacing the base plate at a distance from the cover plate and for distributing the first fluid in the collector being provided, the base plate having first openings for the receipt and sealed fastening of tube ends of the tubes of the tube/rib block, the first openings in the base plate being surrounded by an edge of the base plate, the spacer having second openings, the first openings being in alignment with the second openings, the second openings being designed to be larger with respect to the first openings, and the second openings being formed with a circumferentially closed edge.

A heat exchanger may alternatively or additionally also be designed in such a way that the collector protrudes over the tube/rib block in a direction transverse to the through-flow direction, and the connections for supplying the first fluid to the collector and for removing the first fluid from the collector being arranged in the protruding region of the collector. This achieves the fact that no complex and additional flanges, etc. requiring additional installation space are to be provided and, in particular, to be soldered on, because the installation space is limited, and massive flange elements are also difficult to solder on, due to their high heat capacity, because the temperature behavior of the massive flange element typically differs from the temperature behavior of thinner sheets.

In a further exemplary embodiment, is also advantageous if the connections are designed as annular passages, into which connecting tubes of a fluid circuit of the first fluid may be inserted. An interface, which is relatively easy to manufacture, may be created thereby for the arrangement and fastening of connecting tubes, which is also cost-effective and has good soldering properties.

The passages can be formed from the base plate or the cover plate and protrude from the collector. This provides an approach, which is easy to manufacture and permits a secure solder joint.

It is also advantageous if the passages are formed from another plate between the base plate and the cover plate, in particular by the intermediate plate or by the distribution plate, the passages engaging with openings in the base plate or the cover plate, and/or the passages extending through openings in the base plate or the cover plate. This achieves the fact that the base plate may be designed to be thinner, which saves material and costs, because the base plate would not be directly responsible for the stability of the fastening of the connecting tubes.

A heat exchanger may alternatively or additionally also be designed in such a way that the base plate has a raised edge region, in particular along the longitudinal side of the base plate, which encompasses the cover plate and optionally the intermediate plate and/or the distribution plate, and/or the cover plate has a raised edge region, in particular along the longitudinal side of the cover plate, which encompasses the base plate and optionally the intermediate plate and/or the distribution plate. It may thus be achieved that the connection of the plates of the collector are securely connected to each other in the correct position prior to soldering, and the encompassing furthermore establishes additional stability against the effect of the internal pressure.

According to a further idea according to the invention, a heat exchanger may alternatively or additionally also be designed in such a way that the base plate and the cover plate and optionally the intermediate plate and/or the distribution plate are each provided with an angled design along a bend line, the bend line of the plates being arranged essentially in the middle of the particular plate between the two longitudinal sides of the particular plate and runs in the longitudinal direction of the particular plate. This achieves the fact that the region of contact with the ribs of the tube/rib block is limited to a narrow region of the bend, which improves and facilitates the runoff of condensation on the outer side of the heat exchanger. As a result, no or only very small amounts of water remain standing in the region of contact between the ribs and the collector, which could possibly freeze and prevent the through-flow of the ribs.

It is particularly preferred if the base plate and the cover plate and optionally the intermediate plate and/or the distribution plate each have a projecting shoulder along a line, in particular, in the region of the bend line. The region of contact with the ribs of the tube/rib block is also limited thereby to a narrow region of the bend, which improves and facilitates the runoff of condensation on the outer side of the heat exchanger. As a result, no or only very small amounts of water remain standing in the region of contact between the ribs and the collector, which could possibly freeze and prevent the through-flow of the ribs.

It is also advantageous if the particular shoulder projects in the direction of the tube/rib block or in the direction away from the tube/rib block. The shoulder in the direction of the tube/rib block reduces the region of contact with the ribs. The shoulder in the direction away from the tube/rib block creates a gap, which also reduces the region of contact with the ribs.

According to a further idea according to the invention, a heat exchanger may alternatively or additionally also be designed in such a way that the base plate and/or the cover plate has/have at least one bulge, which extends at least partially in the longitudinal direction of the base plate or the cover plate and is used, in particular, to distribute fluid and/or to collect fluid. The internal fluid distribution is improved thereby, because a greater inner volume of the collector is available. At the same time, a bulge or bulges also reduce(s) the region of contact with the ribs, whereby no or only very small amounts of water remain standing in the region of contact between the ribs and the collector, which could possibly freeze and prevent the through-flow of the ribs.

It is particularly advantageous if the base plate and/or the cover plate has/have at least two bulges, which extend at least partially in the longitudinal direction of the base plate or the cover plate and are used, in particular, to distribute fluid and/or to collect fluid. For example, the flow cross-section may thus be increased in different flow paths, which improves the through-flow and reduces the pressure drop.

The at least two bulges of the base plate and/or the cover plate can have the same design or different designs in section, in particular, in a section in a plane in parallel to the air flow direction. In the case of the different design, the cross-section may be adapted to the fluid, in particular to the state of the fluid. For example, a region having inflowing liquid fluid may be provided with a smaller design that a region for fluid emerging in the evaporated state. Regions arranged therebetween may also be correspondingly adapted in their cross-section.

It is also advantageous if the at least two bulges having different designs in a section in a plane in parallel to the air flow direction are designed in such a way that one bulge of the two bulges is designed to be higher or deeper or lower or less deep and/or wider or narrower in height or depth and/or in width with respect to the plane in parallel to the air flow direction than the other bulge of the two bulges. A suitable individual adaptation of the cross-section of the bulges may be achieved thereby.

The base plate and/or the cover plate can form a step, which extends in the longitudinal direction of the base plate and/or the cover plate in such a way that the base plate and/or the cover plate essentially form(s) at least two planes, which are arranged to be offset with respect to each other, due to the step. An ingenious adaptation to the given installation space conditions is possible thereby, in particular if the bulges are designed to have different heights or depths.

The plates of at least one collector can each have recesses in alignment with each other, which each form a channel crossing the collector, in particular as a condensate runoff. It may be achieved thereby that condensate from the tube/rib block may flow off through the collector, which improves the condensate runoff.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
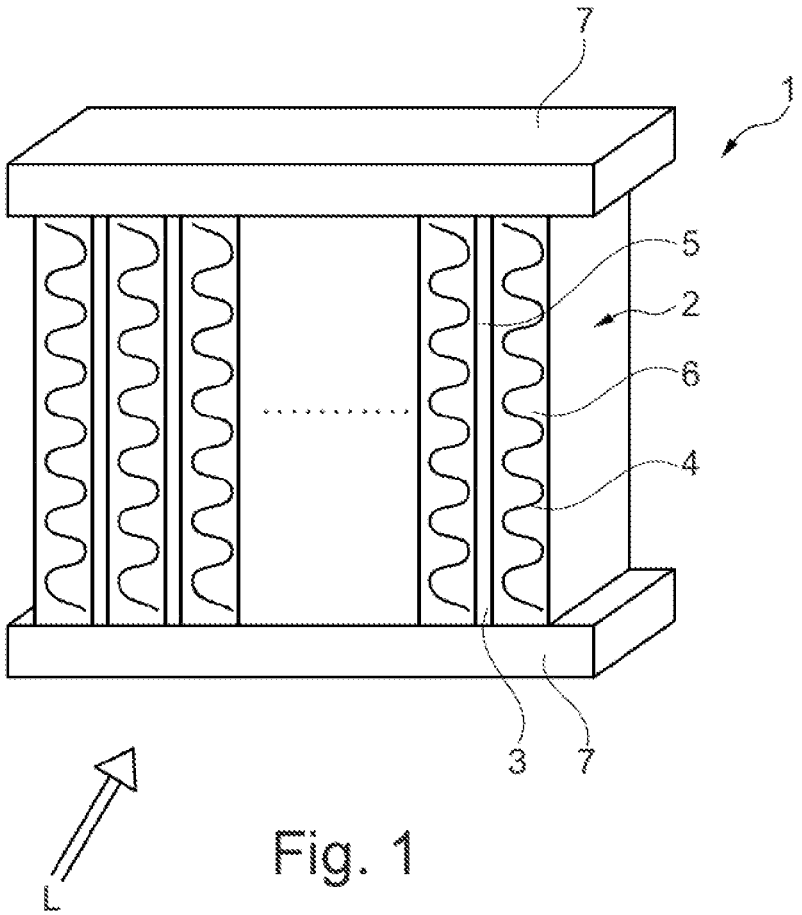
FIG. 1 shows a schematic representation of an exemplary embodiment of a heat exchanger according to the invention.

FIG. 1 shows a highly schematic representation of a first exemplary embodiment of a heat exchanger 1 according to the invention.

Heat exchanger 1 includes a tube/rib block 2 made up of tubes 3 and ribs 4. Ribs 4 may be arranged, for example, as corrugated ribs between tubes 3.

Figure 2:
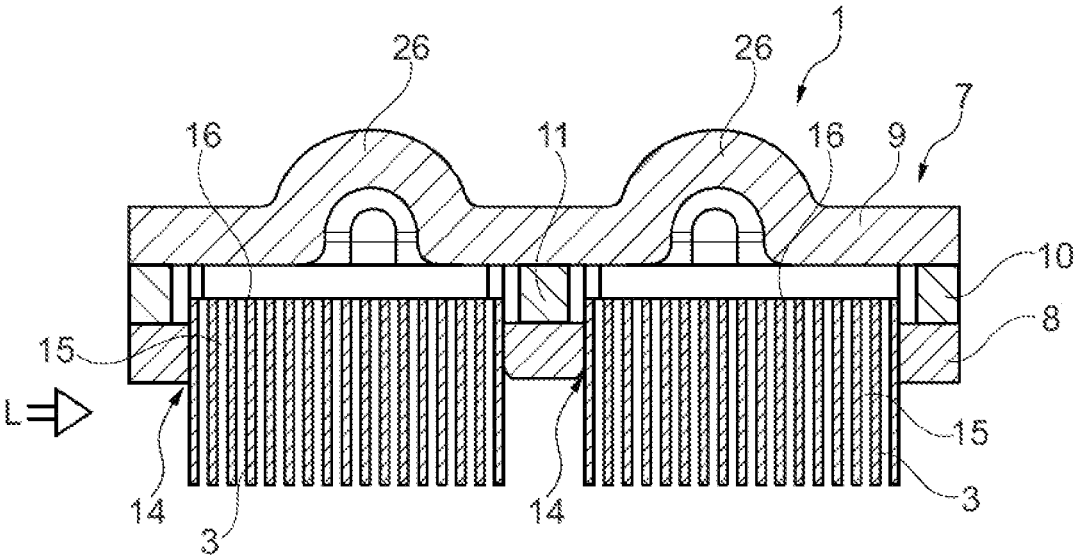
FIG. 2 shows a schematic partial sectional representation of an exemplary embodiment of a heat exchanger according to the invention.

Tubes 3 may be arranged one after the other in a single row or multiple rows in air flow direction L. Tubes 3 may be arranged, for example, one after the other in two rows, as indicated in FIG. 2.

Tubes 3 form fluid channels 5 for conducting a first fluid. The first fluid may be, for example, a refrigerant, for example R744 or R1234yf, etc.

Ribs 4 arranged between tubes 3 form a second fluid channel 6 for conducting a second fluid, which flows around tubes 3. In the illustrated exemplary embodiment, the second fluid is, for example, air.

A collector 7 is arranged at at least one end of tube/rib block 2. In the illustrated exemplary embodiment, two collectors 7 are provided, one collector 7 in each case at an end of tube/rib block 2.

Particular collector 7 communicates with fluid channels 5 of tubes 3, so that the first fluid may flow out of collector 7 into tubes 3, and the first fluid may also flow out of tubes 3 into collector 7. At least one partition wall may be provided in the at least one collector 7 to internally divide corresponding collector 7.

The at least one collector 7 is provided with a plate-type design. Both collectors 7 may also be provided with a plate-type design. Reference is made to FIGS. 2 through 5 for an explanation of the plate-type design.

Collector 7 includes at least one base plate 8 and a cover plate 9, which are stacked and soldered in a sealed manner.

A spacer 10 is furthermore provided for spacing base plate 8 at a distance from cover plate 9 and for distributing the first fluid in collector 7.

The spacer 10 may be designed as an intermediate plate 11, which is arranged between base plate 8 and cover plate 9; cf. FIG. 2. The spacer 10 may alternatively also be designed as an intermediate element or be designed as intermediate elements, which is or are integrated into base plate 8 and/or into cover plate 9, so that the distance between base plate 8 and cover plate 9 is maintained, and the first fluid may flow within collector 7.

Figure 3:
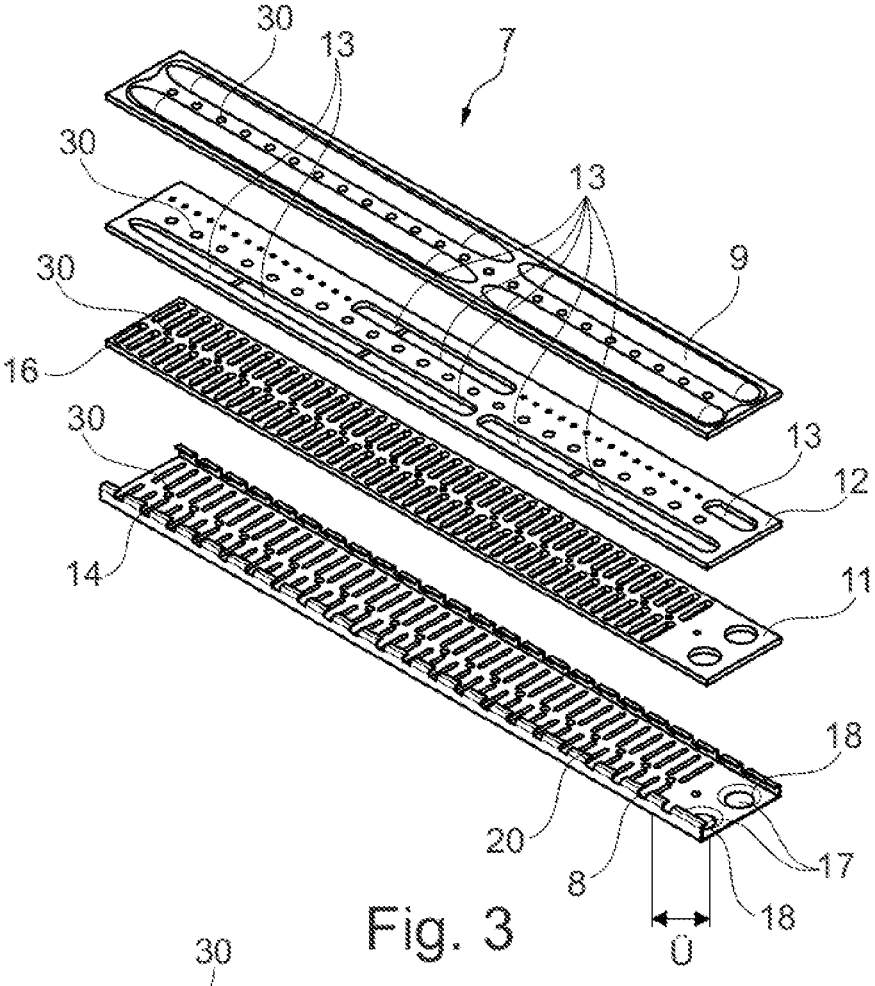
FIG. 3 shows a schematic representation of plates of a collector of a heat exchanger according to the invention.
Figure 4:
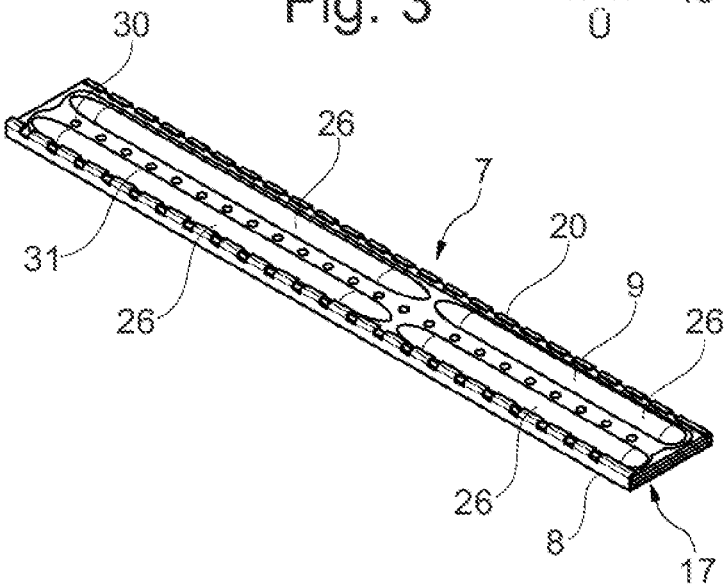
FIG. 4 shows a schematic, perspective representation of the collector according to the arrangement of the plates from FIG. 3.

In the exemplary embodiment in FIGS. 3 and 4, it is also apparent that not only is collector 7 formed from base plate 8 and cover plate 9, but that an intermediate plate 11 and furthermore a distribution plate 12 are also arranged between base plate 8 and cover plate 9. Distribution plate 12 has channel openings 13, which extend in the longitudinal direction of collector 7 and are used to distribute the first fluid in collector 7.

Base plate 8 has first openings 14 for the receipt and sealed fastening of tube ends 15 of tubes 3 of tube/rib block 2.

First openings 14 in base plate 8 are each surrounded by an edge of base plate 8, so that tube ends 15, which are inserted into first openings 14, may be circumferentially soldered to base plate 8 or otherwise connected thereto in a sealed manner.

It is furthermore apparent in FIGS. 2 and 3 that the spacer 10, in particular intermediate plate 11, has second openings 16, first openings 14 being in alignment with second openings 16.

Second openings 16 are designed to be larger with respect to first openings 14, a kind of step being provided in each case from first openings 14 in the direction of second openings 16, so that, during soldering, no solder runs into the tube openings of tubes 3, which are inserted into first openings 14.

To reduce the lateral installation space, second openings 16 are designed to be laterally open, as illustrated in FIG. 3.

Figure 5:
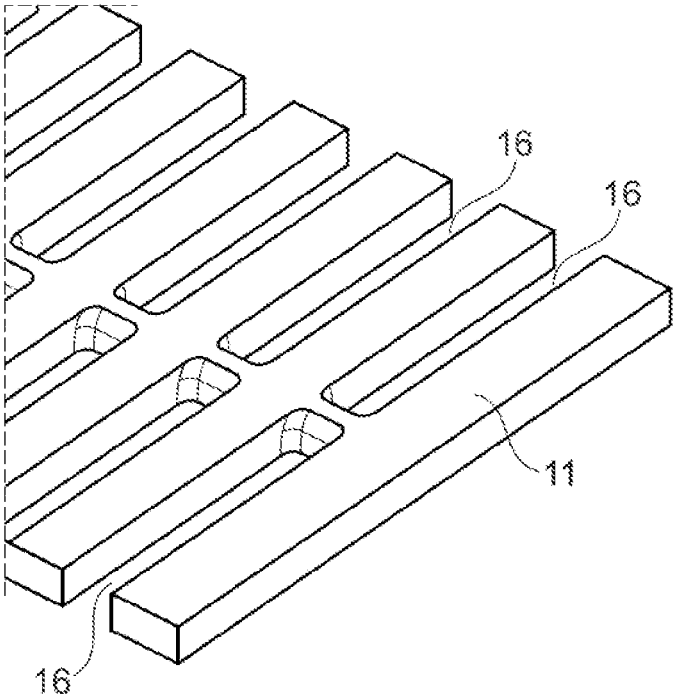
FIG. 5 shows a schematic partial representation of an intermediate plate of a collector of a heat exchanger according to the invention.

FIG. 5 also shows an exemplary embodiment, which has a cutout for an intermediate plate 11, in which second openings 16 are designed to be laterally open.

It is apparent that the side web of intermediate plate 11 is removed, so that second openings 16 may be designed thereby to be open. As a result, the omission of the side web laterally reduces the installation space required for intermediate plate 11, so that collector 7 as a whole may be provided with a narrower design.

Alternatively, in some exemplary embodiments, a web may, however, also be present, so that second openings 16 may alternatively also be each provided with a closed design.

it is also apparent from FIGS. 3 and 4, for example, that, in one advantageous exemplary embodiment, collector 7 protrudes over tube/rib block 2 in a direction transverse to through-flow direction L, and connections 17 for supplying the first fluid to collector 7 and for removing the first fluid from collector 7 are arranged in protruding region U of collector 7.

Figure 12:
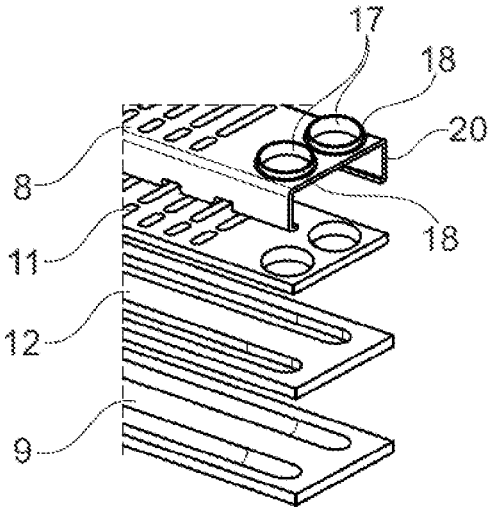
FIG. 12 shows a schematic partial representation of plates of a collector of a heat exchanger according to the invention.
Figure 13:
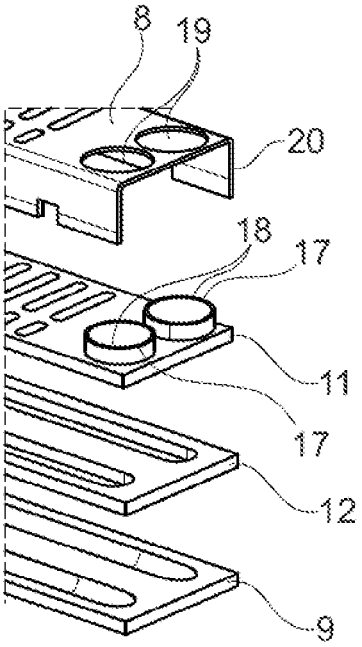
FIG. 13 shows a schematic partial representation of plates of a collector of a heat exchanger according to the invention.

It is apparent, cf. FIGS. 3, 12 and 13, that connections 17 are designed as annular passages 18, into which connecting tubes of a fluid circuit of the first fluid may be inserted.

In principle, passages 18 may be formed from base plate 8 and protrude from base plate 8, or they may possibly be formed from cover plate 9 and protrude therefrom, so that passages 18 optionally protrude from collector 7. A stable variant exists if passages 18 are formed from base plate 8, and the connecting tubes are connected to collector 7 from the side of tube/rib block 2, because passages 18 protrude in the direction of tube/rib block 2.

Alternatively, passages 18 may also be formed from another plate 11, 12 between base plate 8 and cover plate 9, depending on which further plate is provided.

Accordingly, the design may be carried out in such a way that passages 18 may be formed from intermediate plate 11 or from distribution plate 12. It is apparent from FIG. 13, for example, that passages 18 are formed from intermediate plate 11.

Passages 18 protrude in the direction of base plate 8. Passages 18 are dimensioned in such a way that they engage with openings 19 in base plate 8, and/or passages 18 also extend through openings 19 in base plate 8. Openings 19 are dimensioned in such a way that they may receive passages 18. Passages 18 are advantageously and optionally dimensioned in their protruding length in such a way that they are longer than the thickness of base plate 8, so that passages 18 may protrude from base plate 8. Passages 18 may advantageously and optionally be dimensioned in their protruding length in such a way that they are not longer than the thickness of base plate 8, so that passages 18 may not protrude from base plate 8 and, for example, are terminated flush with base plate 8.

Alternatively, the design may also be carried out in such a way that passages 18 may be formed from intermediate plate 11 or from distribution plate 12 and protrude in the direction of cover plate 9. Passages 18 would protrude in the direction of cover plate 9. Passages 18 may be dimensioned in such a way that they engage with openings 19 in cover plate 9, and/or passages 18 also extend through openings 19 in cover plate 9. Openings 19 are dimensioned in such a way that they may receive passages 18. Passages 18 are advantageously and optionally dimensioned in their protruding length in such a way that they are longer than the thickness of cover plate 9, so that passages 18 may protrude from cover plate 9. Passages 18 may advantageously and optionally be dimensioned in their protruding length in such a way that they are not longer than the thickness of cover plate 9, so that passages 18 may not protrude from cover plate 9 and, for example, are terminated flush with cover plate 9.

According to a further aspect, in another exemplary embodiment, base plate 8 may have a raised edge region 20, cf. for example, FIGS. 3, 4, 6, 7, 9, 12 and 13. Raised edge region 20 is raised, in particular, along longitudinal side of base plate 8 and is optionally crimped around the edge of cover plate 9, so that a form-fitting connection is achieved between base plate 8 and cover plate 9 with all plates optionally arranged therebetween.

Raised edge 20 of base plate 8 encompasses cover plate 9 and optionally intermediate plate 11 and/or distribution plate 12.

Alternatively, instead of base plate 8, cover plate 9 may also be designed to have a raised edge 20, in particular, along the longitudinal side of cover plate 9, which encompasses base plate 8 and plates 11, 12 optionally arranged therebetween.

Figure 10:
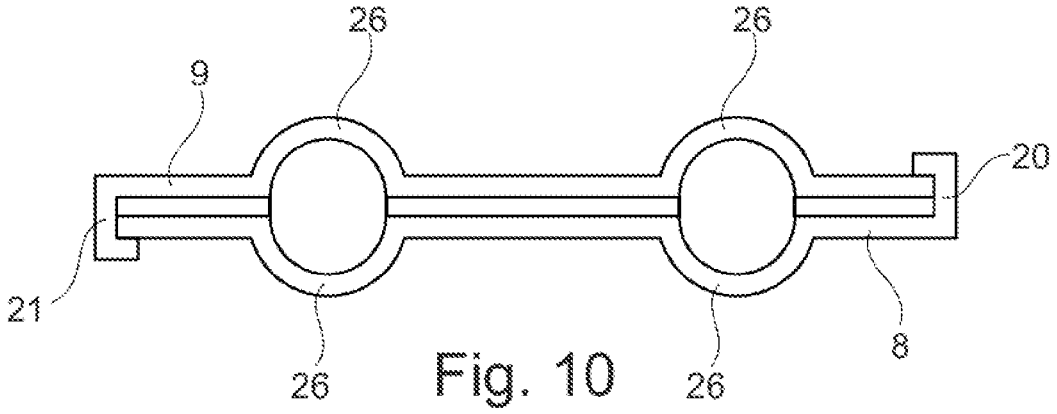
FIG. 10 shows a schematic partial sectional representation of a further exemplary embodiment of a heat exchanger according to the invention.

According to FIG. 10, the embodiment may also be such that base plate 8 has a raised, protruding edge region 20, and cover plate 9 also has a raised, protruding edge region 21, which each encompass the stack.

Figure 6:
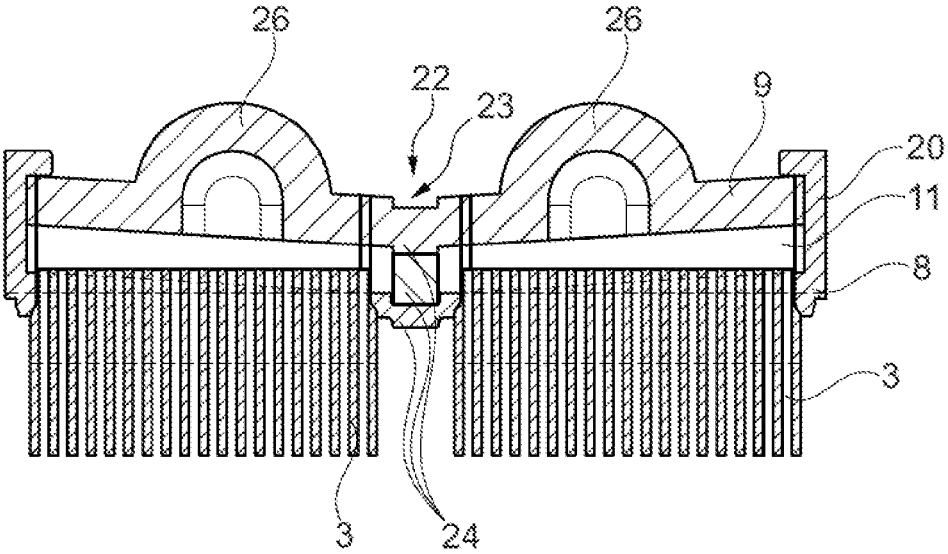
FIG. 6 shows a schematic partial sectional representation of a further exemplary embodiment of a heat exchanger according to the invention.
Figure 7:
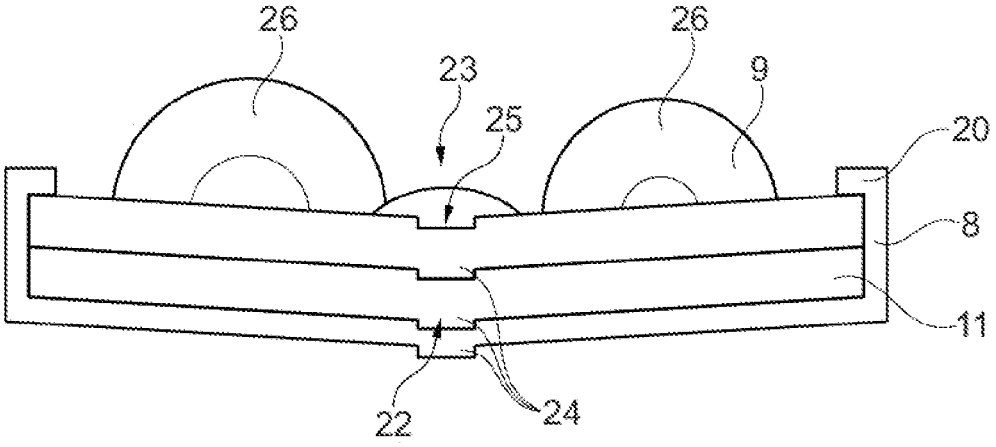
FIG. 7 shows a schematic partial sectional representation of a further exemplary embodiment of a heat exchanger according to the invention.

According to a further aspect, in another exemplary embodiment, base plate 8 and cover plate 9 and optionally intermediate plate 11 and/or distribution plate 12 are each provided with an angled design along a bend line 22; cf. FIGS. 6 and 7. FIGS. 6 and 7 show how base plate 8, cover plate 9 and an intermediate plate 11 arranged therebetween are provided with an angled design. Intermediate plate 11 may optionally also be omitted, or at least one further plate, such as distribution plate 12, may be provided, which also has an angled design.

Bend line 22 of plates 8, 9, 11 and/or 12 is arranged, for example, essentially in the middle of particular plate 8, 9, 11 and/or 12 between the two longitudinal sides of particular plate 8, 9, 11 and/or 12, bend line 22 running, for example, in the longitudinal direction of particular plate 8, 9, 11 and/or 12. Alternatively, bend line 22 may also run not in the middle and be arrange asymmetrically between the two longitudinal sides of plates 8, 9, 11 and/or 12.

According to a further aspect, in another exemplary embodiment, base plate 8 and cover plate 9 and optionally intermediate plate 11 and/or distribution plate 12 each have a protruding shoulder 24 along a line 23, in particular bend line 22.

FIGS. 6 and 7 show that particular shoulder 24 protrudes in the direction of tube/rib block 2. Alternatively, particular shoulder 24 may also protrude in the direction away from the tube/rib block.

Shoulders 24 are formed by stamping, so that the shoulder protrudes on a side of plate 8, 9, 11 and/or 12, and a recess 25 is formed on the other side of plate 8, 9, 11 and/or 12. Shoulders 24 optionally engage with recesses 25 of adjacent plates.

According to a further aspect, in another exemplary embodiment, base plate 8 and/or cover plate 9 has/have at least one bulge 26, which extends at least partially in the longitudinal direction of base plate 8 or cover plate 9 and is/are used, in particular, to distribute fluid and/or to collect fluid. Reference is hereby made to FIGS. 2 through 4 and 6 through 11.

Base plate 8 and/or cover plate 9 may have at least two bulges 26, which extend at least partially in the longitudinal direction of base plate 8 or cover plate 9 and are used, in particular, to distribute fluid and/or to collect fluid.

Figure 9:
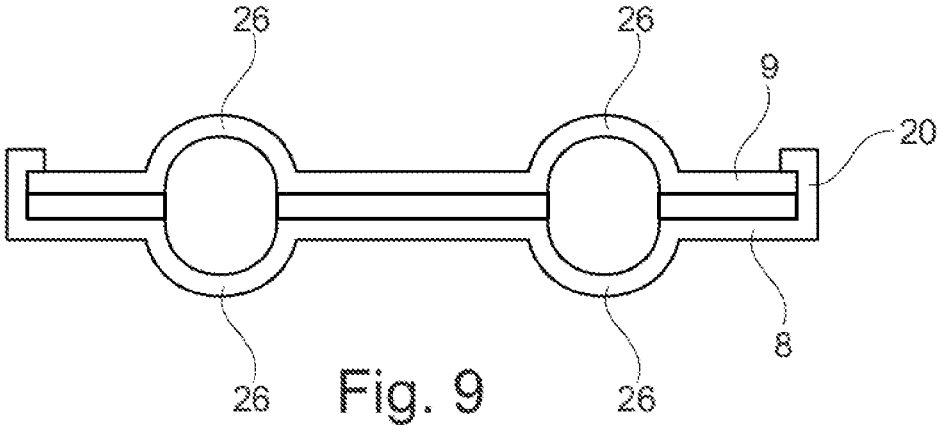
FIG. 9 shows a schematic partial sectional representation of a further exemplary embodiment of a heat exchanger according to the invention.

The at least two bulges 26 of base plate 8 and/or cover plate 9 are advantageously provided with the same design in section, in particular in a section in a plane in parallel to air flow direction L. The two bulges 26 of base plate 8 may the same, and also the two bulges 26 of cover plate 9 may be the same. Bulges 26 of base plate 8 and of cover plate 9 may furthermore also be the same. FIG. 2 as well as FIG. 6 each show that bulges 26 of cover plate 9 are provided with the same design. FIGS. 9 and 10 show that bulges 26 of base plate 8 and of cover plate 9 each have the same design.

The at least two bulges 26 of base plate 8 and/or cover plate 9 are advantageously provided with different designs in section, in particular in a section in a plane in parallel to air flow direction L.

Figure 8:
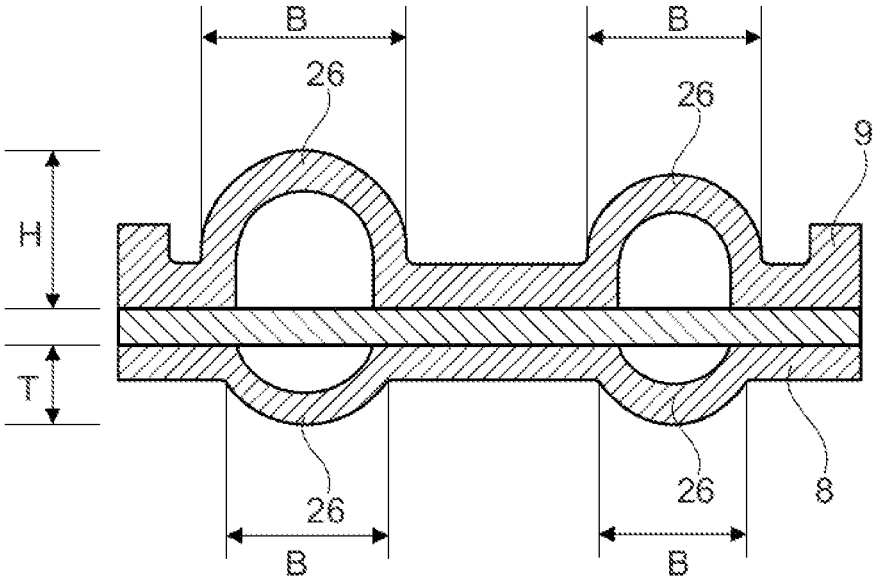
FIG. 8 shows a schematic partial sectional representation of a further exemplary embodiment of a heat exchanger according to the invention.

FIG. 8 shows that bulges 26 of base plate 8 and of cover plate 9 each have different designs. The two bulges 26 of base plate 8 may have different designs, as may the two bulges 26 of cover plate 9. As a whole, all four bulges 26 therefore have different designs.

In one exemplary embodiment, the at least two bulges 26 having different designs in a section in a plane in parallel to the air flow direction are designed in such a way that one bulge 26 of the two bulges 26 is designed to be higher or deeper or lower or less deep and/or wider or narrower in height H or depth T and/or in width B with respect to the plane in parallel to air flow direction L than the other bulge 26 of the two bulges 26; cf., for example, FIG. 8.

Figure 11:
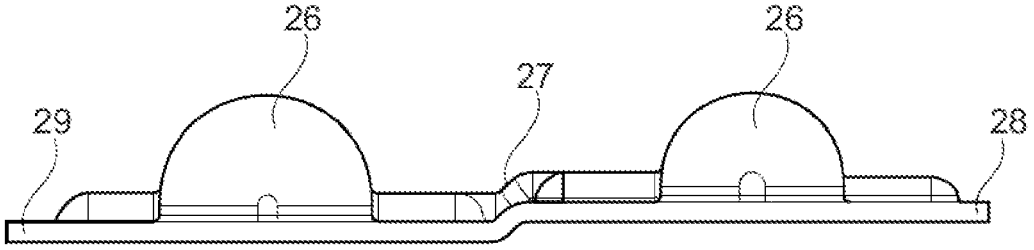
FIG. 11 shows a schematic representation of a cover plate of an exemplary embodiment of a heat exchanger according to the invention.

According to a further aspect according to another exemplary embodiment, base plate 8 and/or cover plate 9 form(s) a step 27, which extends in the longitudinal direction of base plate 8 and/or cover plate 9 in such a way that base plate 8 and/or cover plate 9 essentially form(s) at least two planes 28, 29, which are arranged to be offset with respect to each other, due to step 27. Plates 11 and/or 12 arranged between base plate 8 and/or cover plate 9 may optionally also be designed with a step 27. Reference is hereby made to FIG. 11.

According to a further aspect, in another exemplary embodiment, plates 8, 9, 11, 12 of at least one collector 7 each have recesses 30 in alignment with each other, which each form a channel 31 crossing collector 7, in particular as a condensate runoff; cf/FIGS. 3 and 4.

The implementation of the different designs of the exemplary embodiments, including their features, may be viewed individually or in selected combinations of different features, even if these combinations are not explicitly shown.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

a tube/rib block made up of tubes and ribs, the tubes forming fluid channels for conducting a first fluid comprising a refrigerant, and the ribs arranged between the tubes forming a second fluid channel for conducting a second fluid comprising air, which flows around the tubes;

at least one collector arranged at at least one end of the tube/rib block, which communicates with the fluid channels of the tubes, the at least one collector being provided with a plate-type design and including at least one base plate and a cover plate, which are stacked and soldered in a sealed manner; and a spacer for spacing the base plate at a distance from the cover plate and for distributing the first fluid in the collector, the base plate having first openings for the receipt and sealed fastening of tube ends of the tubes of the tube/rib block, the tube ends being inserted into the first opening, the first openings in the base plate being surrounded by an edge of the base plate, wherein the spacer has second openings, the second openings being configured directly opposite from each other along the longitudinal axis of the spacer, the first openings being in alignment with the second openings, the second openings being designed to be larger with respect to the first openings and being designed with an open end and a closed end, the closed end being adjacent to the longitudinal axis of the spacer and the open end being disposed at the outer perimeter of the spacer, and each first opening having a step in the direction of the second opening thereby averting solder runs into the tubes inserted into the first openings.

2. The heat exchanger according to claim 1, wherein the spacer is designed as an intermediate plate, which is arranged between the base plate and the cover plate.

3. The heat exchanger according to claim 1, wherein the spacer is designed as an intermediate element or as intermediate elements, which is or are integrated into the base plate and/or into the cover plate.

4. The heat exchanger according to claim 2, wherein a distribution plate is furthermore arranged, which has channel openings, which extend in the longitudinal direction of the collector.

5. The heat exchanger according to claim 1, wherein the collector protrudes over the tube/rib block in a direction transverse to the through-flow direction, and the connections for supplying the first fluid to the collector and for removing the first fluid from the collector are arranged in the protruding region of the collector.

6. The heat exchanger according to claim 5, wherein the connections are designed as annular passages into which connecting tubes of a fluid circuit of the first fluid may be inserted.

7. The heat exchanger according to claim 6, wherein the annular passages are formed from the base plate or the cover plate and protrude from the collector.

8. The heat exchanger according to claim 6, wherein the annular passages are formed from another plate between the base plate and the cover plate, the another plate being an intermediate plate or a distribution plate, the annular passages engaging with openings in the base plate or the cover plate, and/or the annular passages extending through openings in the base plate or the cover plate.

9. The heat exchanger according to claim 1, wherein the base plate has a raised edge region along the longitudinal side of the base plate, which encompasses the cover plate and optionally an intermediate plate and/or a distribution plate, and/or the cover plate has a raised edge region along the longitudinal side of the cover plate, which encompasses the base plate and optionally the intermediate plate and/or the distribution plate.

10. The heat exchanger according to claim 1, wherein the base plate and the cover plate and optionally an intermediate plate and/or a distribution plate are each provided with an angled design along a bend line, the bend line of the plates being arranged essentially in the middle of the particular plate between the two longitudinal sides of the particular plate and running in the longitudinal direction of the particular plate.

11. The heat exchanger according to claim 1, wherein the base plate and the cover plate and optionally an intermediate plate and/or a distribution plate each have a protruding shoulder along a line in the region of a bend line.

12. The heat exchanger according to claim 11, wherein the protruding shoulder protrudes in the direction of the tube/rib block or in the direction away from the tube/rib block.

13. The heat exchanger according to claim 1, wherein the base plate and/or the cover plate has/have at least one bulge, which extends at least partially in the longitudinal direction of the base plate or the cover plate and is used to distribute fluid and/or to collect fluid.

14. The heat exchanger according to claim 13, wherein the base plate and/or the cover plate has/have at least two bulges, which extend at least partially in the longitudinal direction of the base plate or the cover plate and are used to distribute fluid and/or to collect fluid.

15. The heat exchanger according to claim 14, wherein the at least two bulges of the base plate and/or the cover plate are provided with the same design or with different designs in a section in a plane in parallel to the air flow direction.

16. The heat exchanger according to claim 15, wherein the at least two bulges having different designs in a section in a plane in parallel to the air flow direction are designed in such a way that one bulge of the two bulges is designed to be higher or deeper or lower or less deep and/or wider or narrower in height or depth and/or in width with respect to the plane in parallel to the air flow direction than the other bulge of the two bulges.

17. The heat exchanger according to claim 1, wherein the base plate and/or the cover plate forms a step, which extends in the longitudinal direction of the base plate and/or the cover plate such that the base plate and/or the cover plate essentially forms at least two planes, which are arranged to be offset with respect to each other, due to the step.

18. The heat exchanger according to claim 1, wherein the plates of at least one collector each have recesses in alignment with each other, which each form a channel crossing the collector as a condensate runoff.

* * * * *